US005927311A

United States Patent [19]

Jager

[11] Patent Number: 5,927,311

[45] Date of Patent: Jul. 27, 1999

[54] PORTABLE SHELTER

[76] Inventor: Bill Jager, 18 Airpark Pl., Guelph, Ontario, Canada, N1L 1B2

[21] Appl. No.: 08/826,075

[22] Filed: Mar. 24, 1997

[51] Int. Cl.[6] ..... E04H 15/36

[52] U.S. Cl. ..... 135/124; 135/125; 135/127

[58] Field of Search ..... 135/123, 124, 135/125, 127, 136, 138, 115, 117, 900, 902, 906

[56] References Cited

U.S. PATENT DOCUMENTS

| | | | |
|---|---|---|---|
| 1,061,547 | 5/1913 | Kennedy et al. . | |
| 2,142,851 | 1/1939 | Jolly . | |
| 2,190,566 | 2/1940 | Julian . | |
| 2,660,186 | 11/1953 | Marshall et al. . | |
| 3,042,053 | 7/1962 | Gabriel . | |
| 3,051,185 | 8/1962 | Reynolds | 135/906 X |
| 3,070,107 | 12/1962 | Beatty . | |
| 3,190,300 | 6/1965 | Wear'n . | |
| 3,223,098 | 12/1965 | Dole, Jr. | 135/127 X |
| 3,474,804 | 10/1969 | Gellert . | |
| 3,726,294 | 4/1973 | Huddle | 135/117 X |
| 3,970,096 | 7/1976 | Nicolai | 135/906 X |
| 4,075,723 | 2/1978 | Bareis et al. . | |
| 4,165,757 | 8/1979 | Marks | 135/906 X |
| 4,404,980 | 9/1983 | Wade . | |
| 4,440,187 | 4/1984 | Fiddler . | |
| 4,646,770 | 3/1987 | Lobato | 135/900 X |
| 4,852,598 | 8/1989 | Griesenbeck | 135/138 X |
| 4,941,499 | 7/1990 | Pelsue et al. . | |
| 4,979,531 | 12/1990 | Toor et al. . | |
| 5,080,123 | 1/1992 | Stein . | |
| 5,253,667 | 10/1993 | Chung . | |
| 5,299,590 | 4/1994 | Deibert et al. . | |
| 5,327,927 | 7/1994 | Oh . | |
| 5,407,291 | 4/1995 | Hazinski et al. . | |
| 5,494,066 | 2/1996 | McMahan . | |
| 5,546,971 | 8/1996 | Leonhardt | 135/127 |
| 5,595,203 | 1/1997 | Espinosa | 135/138 X |

*Primary Examiner*—Carl D. Friedman
*Assistant Examiner*—Dennis L. Dorsey
*Attorney, Agent, or Firm*—Riches, McKenzie & Herbert

[57] ABSTRACT

A shelter having at least two spaced parallel longitudinal support rod members coupled to a sheet with the sheet carrying at least one transverse support rod members which assists in maintaining the longitudinal support rod members in spaced relation and in which the sheet and each transverse support rod member are slidable as a unit longitudinally relative the longitudinal support rod members. The longitudinal rod members may be rigid or flexible but preferably form an arched configuration. The longitudinal rod members are preferably received in elongate continuous sleeves coupled to the sheet but various other members for coupling may be provided including discrete sleeve segments or spaced loops.

20 Claims, 9 Drawing Sheets

40
16
32
12
54
22
36
38
26
14
58
60
44
48
80
36
40
54
24
42
38
42
78
52
46
50

PORTABLE SHELTER

SCOPE OF THE INVENTION

This invention relates to a shelter, and more particularly to a simple, portable, collapsible shelter particularly adapted as a shelter from sun, wind and/or rain and which is well adapted for use on the ground as at a beach.

An object of this invention is to provide a shelter which is extremely light in weight and foldable so as to be easily transported and handled.

Another object of the present invention is to provide a simplified construction for a shelter which permits a sheet providing shelter to be moved relative support members to different relative positions.

SUMMARY OF THE INVENTION

The present invention provides a shelter having at least two spaced parallel longitudinal support rod members coupled to a sheet with the sheet carrying at least one transverse support rod member which assists in maintaining the longitudinal support rod members in spaced relation and in which the sheet and each transverse support rod member are slidable as a unit longitudinally relative the longitudinal support rod members. The longitudinal rod members may be rigid or flexible but preferably form an arched configuration. The longitudinal rod members are preferably received in elongate continuous sleeves coupled to the sheet but various other methods for coupling may be provided including discrete sleeve segments or spaced loops. Many attachment members may be provided to couple the transverse rod members to the sheet including sleeves, pockets, sockets, grommets and pin members, as are known in the tent art.

In one preferred aspect the present invention provides a portable shelter comprising:

a trapezoidal sheet of fabric with parallel first and second sides and with first and second ends;

a first elongate longitudinal support rod member having a first end and a second end;

a second elongate longitudinal support rod member having a first end and a second end;

at least one elongate transverse support rod member having a first end and a second end;

first sleeve means disposed along the first side of the sheet;

second sleeve means disposed along the second side of the sheet;

the first longitudinal support rod member coupled to the sheet received in the first sleeve means for sliding therein parallel the first side;

the second longitudinal support rod member coupled to the sheet received in the second sleeve means for sliding therein parallel the second side;

each of the first and second longitudinal support rod members having their first and second ends extending beyond the first and second ends respectively of the sheet to support the shelter;

each transverse support rod member having its first end coupled to the sheet adjacent the first side and its second end coupled to the sheet adjacent the second side and extending therebetween transversely relative the first and second longitudinal support rod members to maintain the first and second longitudinal support rod members in spaced relation;

the first and second ends of each transverse support rod member coupled to the sheet independently of the first and second longitudinal support rod members such that the sheet with each transverse support rod member coupled thereto may slide longitudinally relative to the first and second longitudinal support rod members.

BRIEF DESCRIPTION OF THE DRAWINGS

Further aspects and advantages of the present invention will become apparent from the following description taken together with the accompanying drawings, in which.

DETAILED DESCRIPTION OF THE PREFERRED EMBODIMENT

Figure 1:
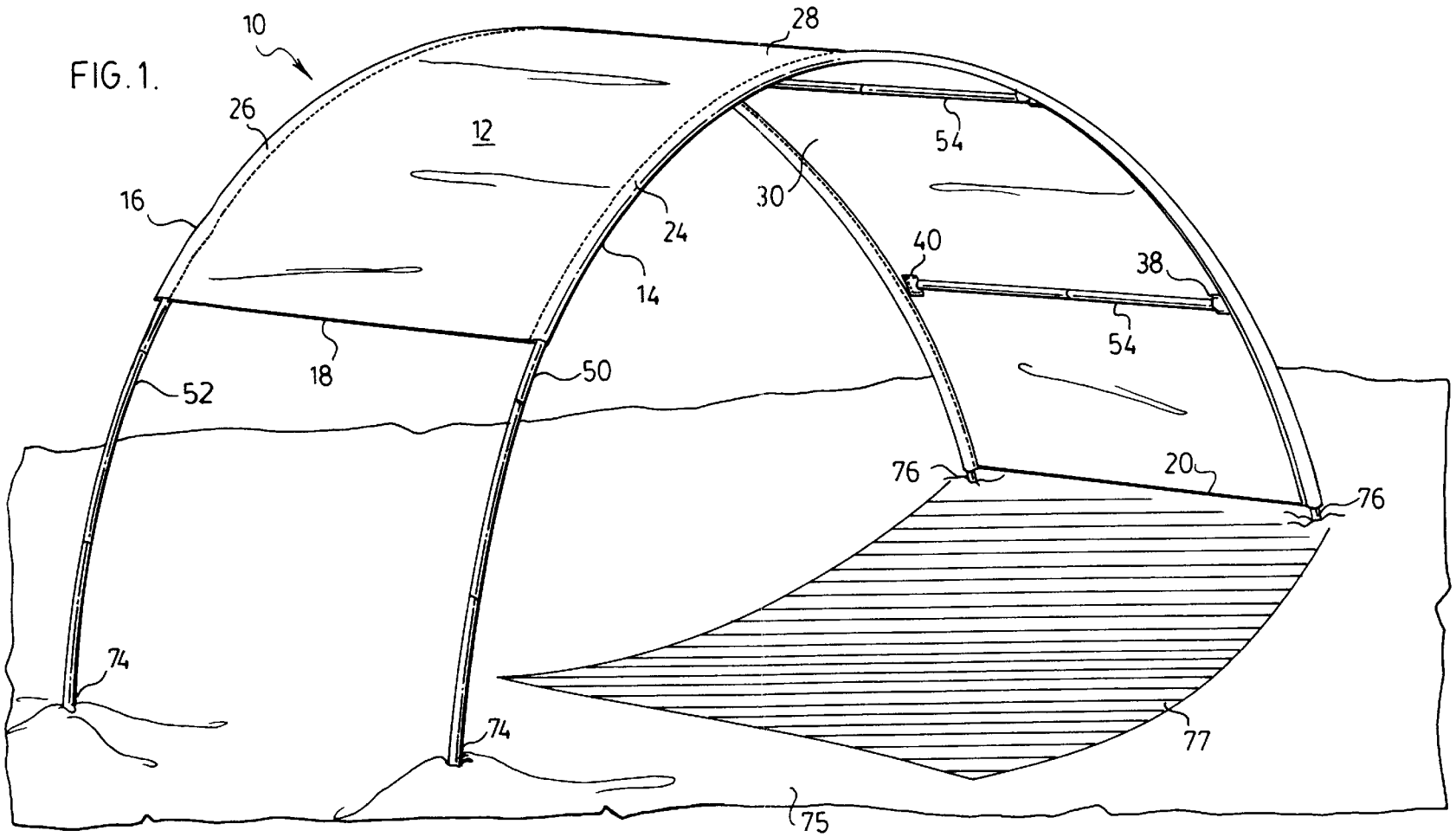
FIG. 1 is a pictorial view of a first embodiment of a shelter in accordance with the present invention shown in use on the ground.
Figure 3:
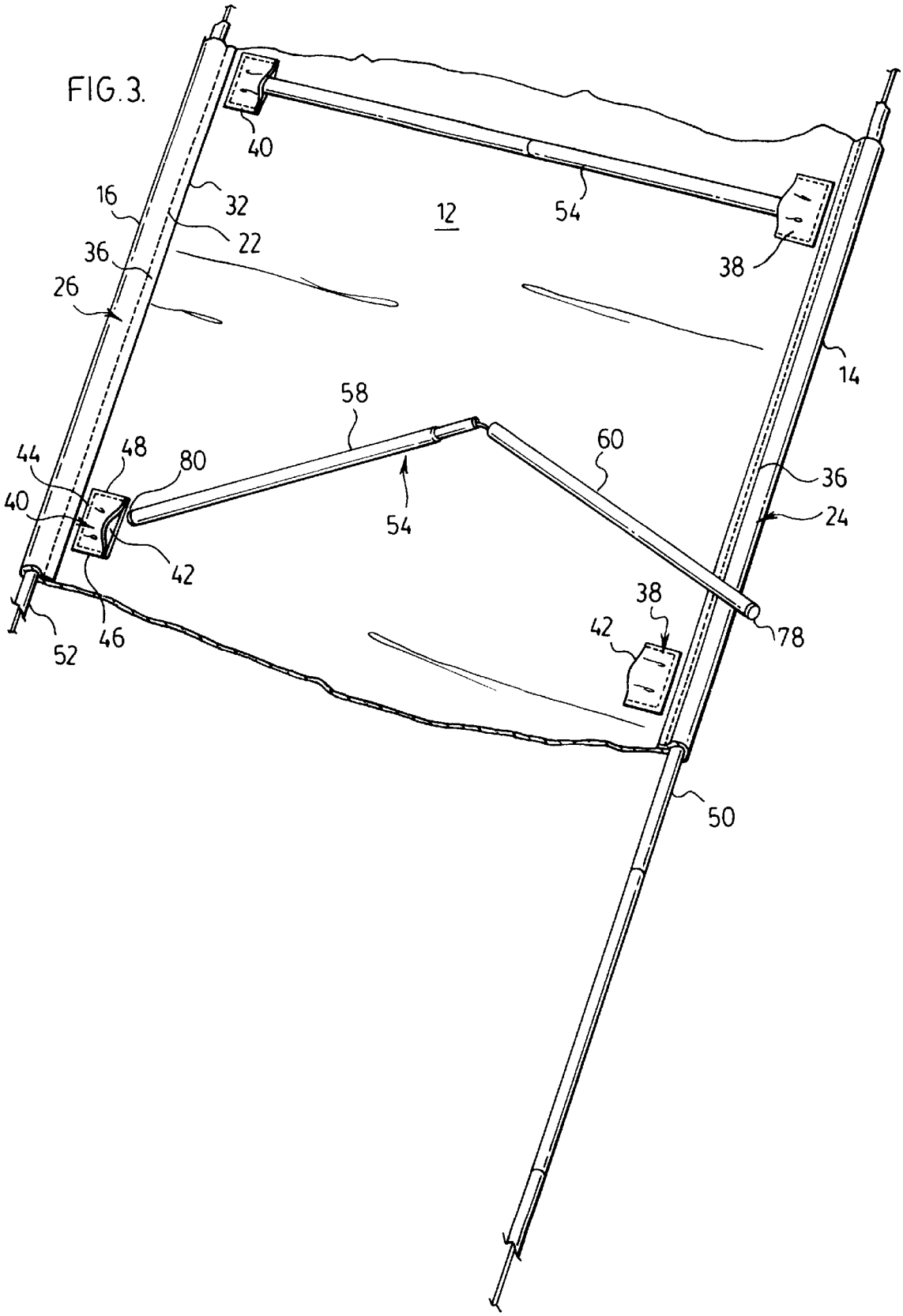
FIG. 3 is an enlarged view of a portion of FIG. 2 illustrating the construction of the transverse rod members.
Figure 4:
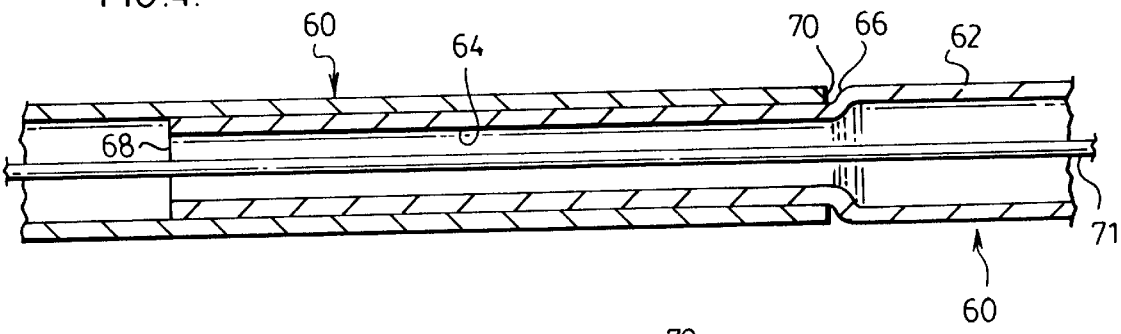
FIG. 4 is a schematic cross sectional view showing the junction of two segments of one of the rod members.

Reference is made first to FIG. 1 which shows a portable shelter 10 in accordance with a first preferred embodiment of the present invention. The shelter has a trapezoidal, preferably rectangular as shown, sheet 12 of fabric, preferably light weight fabric of Nylon material. The sheet 12 has a first side 14 and a second side 16 which are parallel and a first end 18 and a second end 20 which also is illustrated as preferably parallel although not necessarily so. At each side of the sheet 12, a portion of the sheet is folded over on itself and secured to itself as preferably by sewing with stitching 22 as best seen in FIG. 3 so as to define a first sleeve 24 extending longitudinally along the entire length of the first side 14 parallel the first side 14 and a second sleeve 26 extending longitudinally along the entire length of the second side 16 parallel the second side 16.

The sheet 12 has an upper surface 28 and a lower surface 30. As best seen in FIG. 3, the sleeves 24 and 26 may be provided by having a portion of the sheet adjacent each side folded over onto the lower surface 30 such that an edge 32 overlies the lower surface 30 spaced inwardly from the side and secured to the lower surface 30 as by the stitching 22. This folded over portion 36 thus forms a hollow sleeve or tube which extends the entire length of the sheet adjacent the side and parallel thereto.

Pairs of pocket members are also provided on the sheet at spaced locations. Each pair of pocket members comprises a first pocket member 38 and a second pocket member 40. Each of these pocket members preferably comprises a short strip of fabric or webbing which is folded to be doubled upon itself so as to present an opening 42 on one end and to be closed by the fold at an opposite end 44 and by stitching on its sides 46 and 48 as shown. Preferably, the pocket is secured to the sheet by stitching which extends along each side 46 and 48 and across the end 44. Each first pocket member 38 is disposed adjacent the first side 14 and has its opening 42 directed towards the second side 16. Each second pocket member 40 is disposed adjacent the second side 16 and has its opening 42 disposed towards the first side 14.

In addition to the sheet 12, the shelter of FIGS. 1 to 7 has two longitudinal support rod members, namely, a first longitudinal rod member 50, a second longitudinal rod member 52 and three transverse support rod members each indicated as 54.

Figure 5:
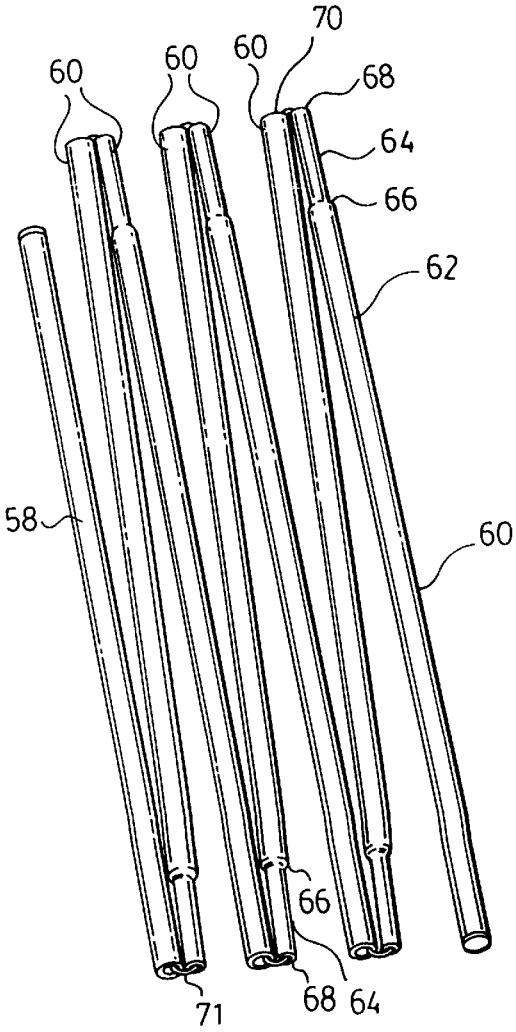
FIG. 5 is a pictorial view of one of the longitudinal support rod members in a folded condition.

Each of the longitudinal rod members 50 and 52 is identical. FIG. 5 shows longitudinal rod member 50 in a collapsed or folded condition. Rod member 50 is shown as being formed from seven rod-like segments. Six of the segments indicated as 60 are identical and vary only in a minor manner from each other. Segment 60 comprises a hollow tube with a major portion 62 of constant diameter and a short portion 64 at one end 68 of reduced diameter terminating at a shoulder 66 where it merges into the enlarged diameter portion 62. The reduced diameter portion 64 at end 68 is adapted to be telescopically received inside the interior of the enlarged diameter portion in the other end 70 of an adjacent tube with the other end 70 to abut the shoulder 66. Segment 58 is identical to segment 60 other than being cut to sever the reduced diameter portion 64. Each of the end segments have cap members which close each remote end of the rod member 50. In known manner, an elastic cord 71 extends continuously through the segments and is secured to each of the end segments to assist in keeping the segments together both when unfolded and when the segments are telescopically received in adjacent segments forming a continuous length as seen in FIGS. 1 and 3.

As best seen in FIG. 3, each transverse rod member 54 is a construction which is the same as that of the longitudinal rod member 50 however with each transverse rod member merely comprising one end segment 58 and one end segment 60.

The shelter is assembled with each longitudinal rod member placed into an unfolded straight configuration and the first longitudinal rod member 50 slid longitudinally into the first sleeve 14 and the second longitudinal rod member 52 slid into the second sleeve 16 with the first ends 74 of each and the second ends 76 of each to extend beyond the first end 18 and second end 20 of the sheet 12, respectively. Each transverse rod member 54 is secured to the sheet by having a first ends 78 engaged in a first pocket member 38 and a second end 80 engaged in a second pocket member 40. The relative spacing between the pocket members and the relative length of each transverse rod member 54 is selected such that when each transverse member 54 is received in its respective pairs of pockets, the sheet is tensioned between the pockets. Preferably, the inherent resiliency of the sheet 12 is sufficient to permit the transverse member 54 to readily be inserted into the pockets by a user.

Figure 2:
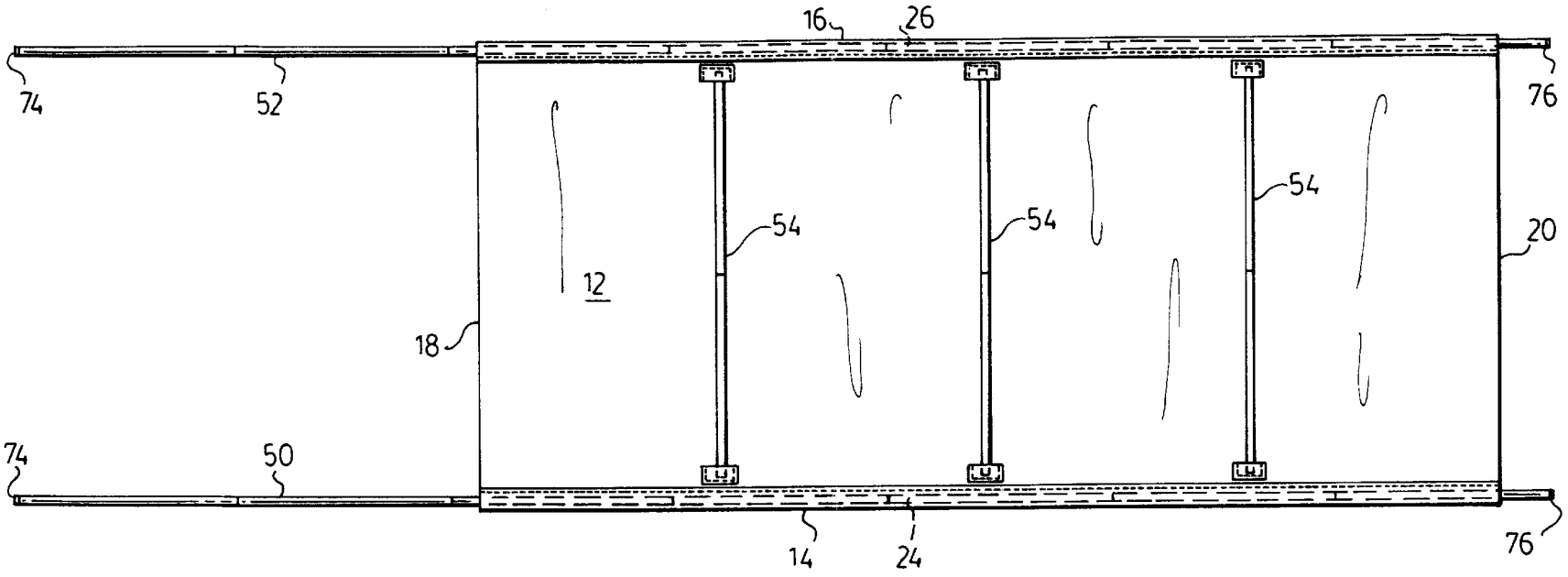
FIG. 2 is a bottom view of the shelter of FIG. 1 in an assembled planar configuration.
Figure 6:
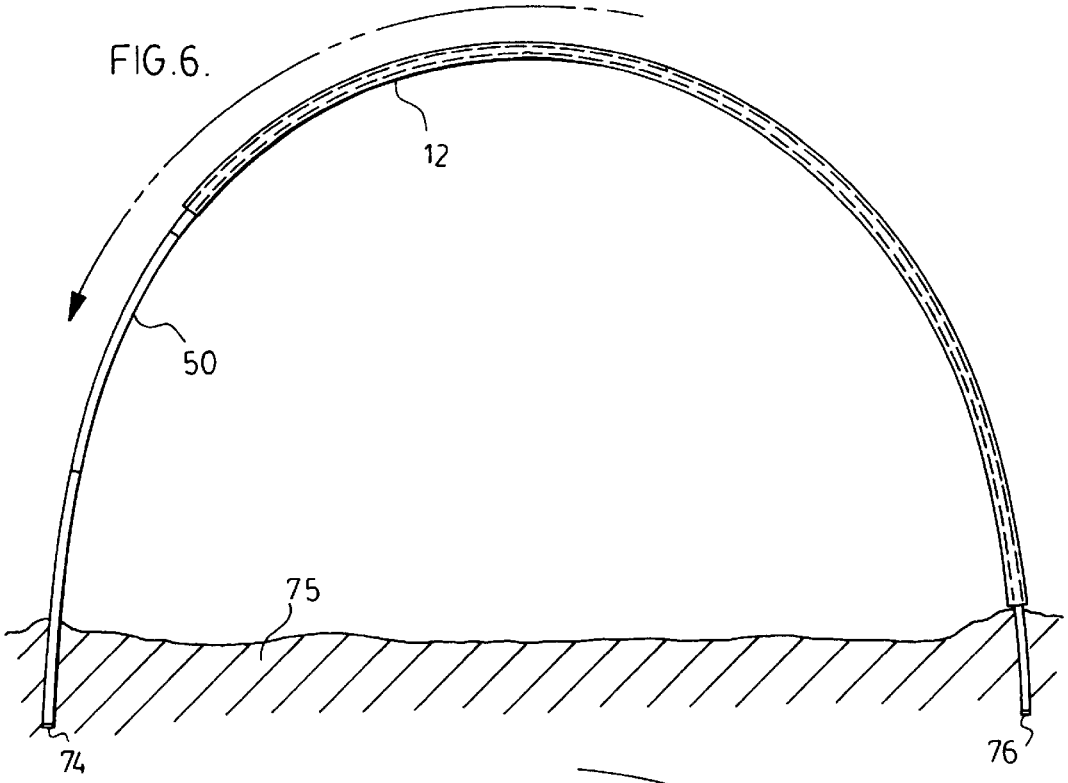
FIG. 6 is a side view of FIG. 1.
Figure 7:
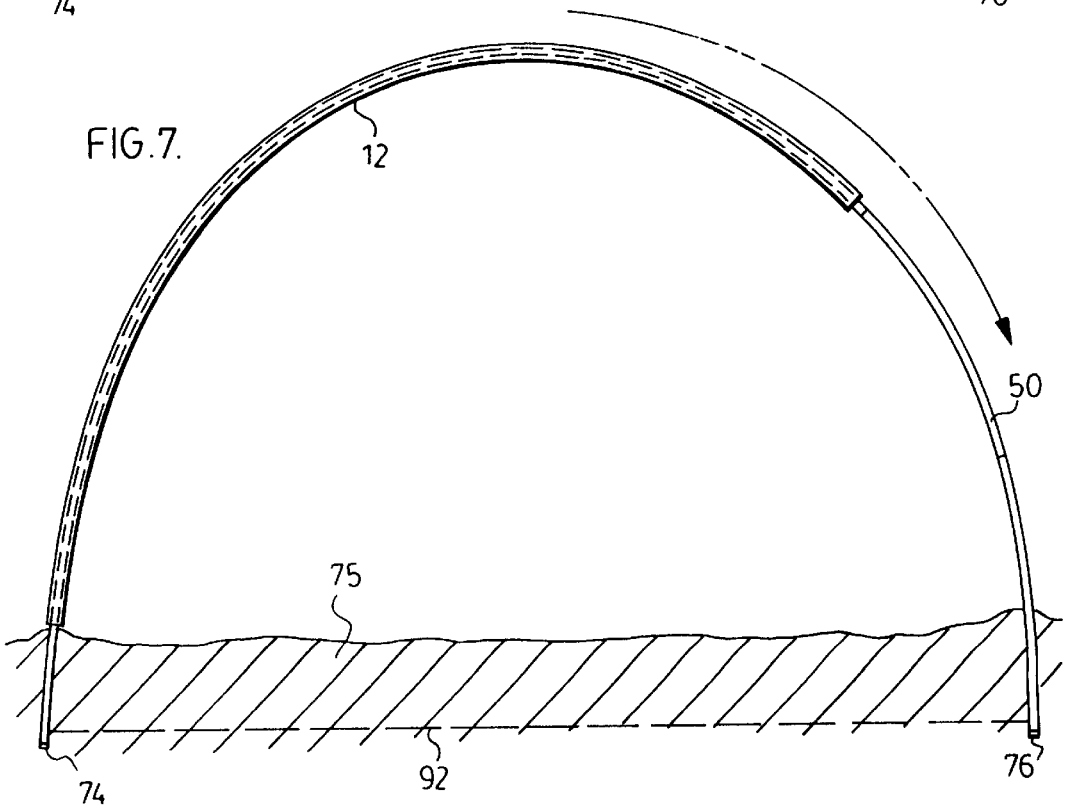
FIG. 7 is a side view identical to FIG. 6 however showing the sheet in a different position than in FIGS. 1 and 6.

As seen in FIG. 2, with the transverse rod members 54 secured in their respective pairs of pockets, the transverse rod member maintains the sheet with the first and second longitudinal rods in spaced parallel relation. FIG. 2 shows the orientation of the shelter when fully assembled in a unbiased position in which it adopts a planar configuration. To place the shelter into the configuration shown in FIG. 1, a user would manipulate the assembled shelter so as to insert the first ends 74 of the longitudinal rod members 50 and 52 into the ground 75 as seen, for example, in FIG. 6. With the first ends 74 of both longitudinal rod members 50 and 52 inserted into the ground, a user would then apply pressure to the second ends 76 of each of the two longitudinal rod members urging them towards the first ends 74 and, thus, bend each of the longitudinal rod member into an arched configuration. While maintaining the longitudinal rod members in this arched configuration, a user would then manually insert the second ends 76 into the ground. As best seen in FIGS. 6 and 7, with the first ends 74 and the second ends 76 of the longitudinal members engaged within the ground, the shelter is secured to the ground in a desired arched configuration.

As seen in FIGS. 6 and 7, the longitudinal support rod members 50 and 52 are of equal length and of a length greater than the length of the sheet 12.

In this arched configuration, it is to be appreciated that the sheet 12 with its transverse rod members 54 is longitudinally slidable on the longitudinal rod members 50 and 52. Thus, the sheet 12 may be slid longitudinally on the longitudinal rod members 50 and 52 between a first position shown in FIG. 6 with the second end 20 of the sheet proximate the second ends of the longitudinal support rod members and a second position shown in FIG. 7 with the first end 18 of the sheet proximate the first ends of the longitudinal support rod members. The unit comprising the sheet and the transverse rod members 54 may be slid as a unit and positioned by a user to assume different positions between the position shown in FIGS. 6 and 7 as may be desired having regard to particular conditions of sun, wind and rain. FIG. 1 shows sheet 12 positioned so as to provide shade in area 77 proximate the second end of the sheet.

The use of flexible longitudinal rod members is particularly advantageous to permit the shelter to be adaptable to withstand relatively strong winds particularly when the end of the sheet on the windward side of the shelter is disposed close to the ground. The arched form of the shelter deflects wind up and over the shelter without causing a shelter to act as a sail and the flexibility longitudinal members assist in partial deflection of the shelter to accommodate wind pressures without being pulled from the ground.

Figure 8:
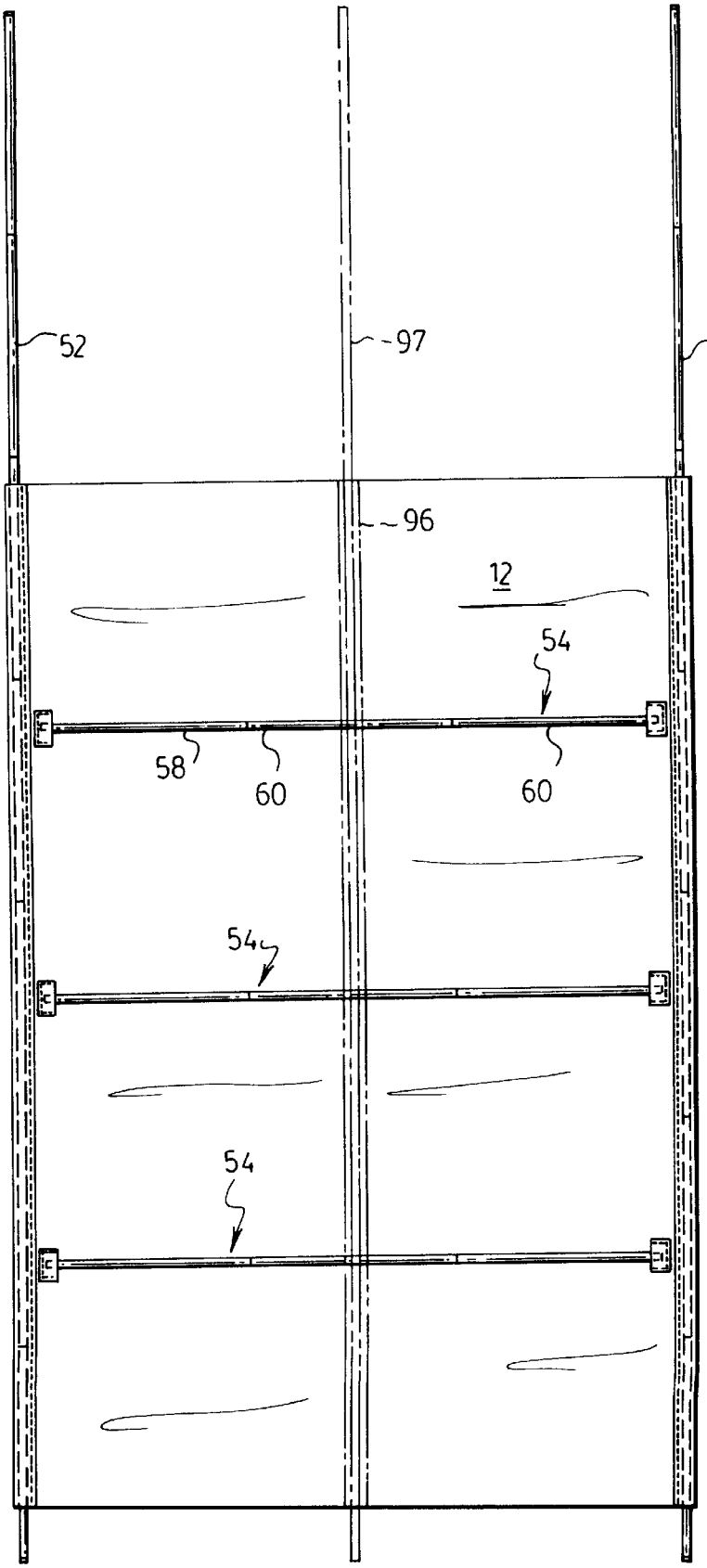
FIG. 8 is a side view of a modified form of shelter of FIG. 1 in a view as similar to that in FIG. 2.

FIG. 8 shows a partial view of a second embodiment in accordance with the present invention which is identical to the first embodiment however which shows a sheet 12 having a slightly greater width between its sides and with this greater width being accommodated by the use of transverse rod member 54 comprising three segments rather than merely two as shown in FIG. 3.

The transverse rod members 54 preferably extend perpendicular to the longitudinal rod members. This is not necessary and transverse rod members could extend at substantial angles from the perpendicular, even for example with transverse rod members crossing each other.

Both the preferred embodiments illustrate a shelter utilizing flexible rods formed from segments. The use of segmented rods is preferred but is not necessary. The rods could comprise single lengths of flexible material. As well, the rods could comprise rigid rods. The rigid rods could, for example, be unitary of a single length or could be formed from rigid segments. Rigid rods could have a desired shape of generally arched configuration or U-shaped or L-shaped or otherwise. The rods could comprise a mixture of rigid segments and flexible segments.

The rods may preferably be formed from a flexible fibreglass or plastic material or from light weight flexible aluminum tubing or the like. Many constructions for collapsible flexible rods are known. An example of one type of the rods is disclosed in U.S. Pat. No. 4,979,539 to Toora et al, issued Dec. 25, 1990.

The sheet 12 preferably comprises a light weight material which preferably has some inherent elastic qualities. The material may preferably be waterproof and/or at least partially impermeable to ultraviolet light.

The preferred embodiment of FIGS. 1 to 8 shows the pockets 38 and 40 located spaced marginally inwardly from the sleeves adjacent each side of the sheet. In another configuration, each end 44 of the pocket may be sewn to the sheet so as to be located with the end 44 overlying stitching 22. In such a configuration with the sleeve sized to relatively closely approximate the diameter of the longitudinal rod members, the transverse tension applied by the transverse rod members to the sheet will effectively be relatively directly applied to the longitudinal rod members albeit this tensioning is to be selected so as to not unduly impede sliding of the sheet 12 longitudinally on the longitudinal rod members. For ease of construction, in another embodiment, each pocket may be received under the folded over portion 36 and extend to the side to the laterally outermost extent of the folded over portion 36.

The preferred embodiments illustrated show the sleeves 24 and 26 as being continuous sleeves forming a hollow tube to engage the longitudinal rod members throughout the entire length of the sheet. Rather than comprise a continuous sleeve, each could comprise merely short segments of sleeves at spaced locations along the length. Alternatively, the sleeves could be replaced by short spaced fabric loops or by ring-like members of plastic or metal secured to the side of the sheet at longitudinally spaced locations.

Figure 9:
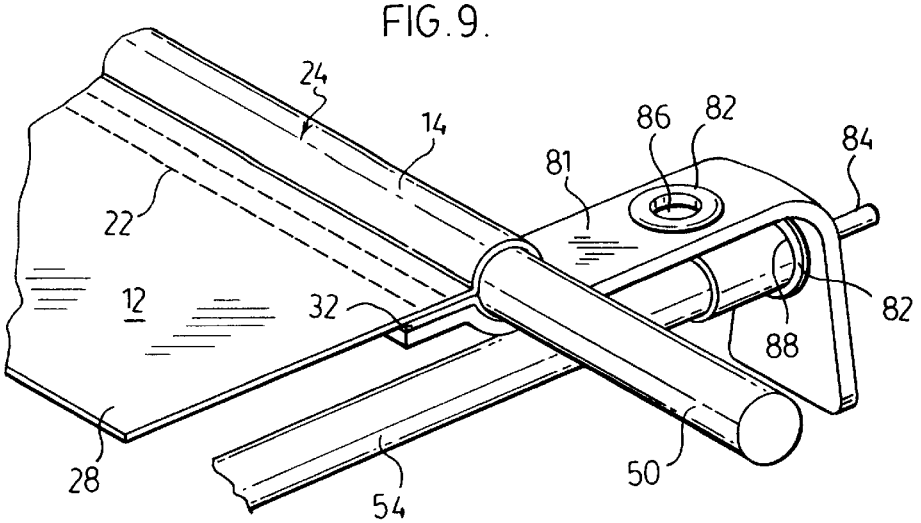
FIG. 9 is a schematic preferred view showing coupling of the transverse support rod member in a grommet.

The preferred embodiment shows pockets 38 and 40 as forming the attachment members for securing each end of the transverse rod members to the sheet 12. Many different types of attachment members may be used. For example, as illustrated in FIG. 9, in substitution of a pocket, a strap member 81 could be provided to extend laterally outwardly from the side of the sheet 12 sewn to the sheet and presenting one or more grommets 82 to receive the ends of the transverse rod members 54 with a reduced diameter portion 84 of rod member 54 to pass through an opening 86 in the socket forming grommet 82 and a shoulder 88 to engage the grommet.

Figure 10:
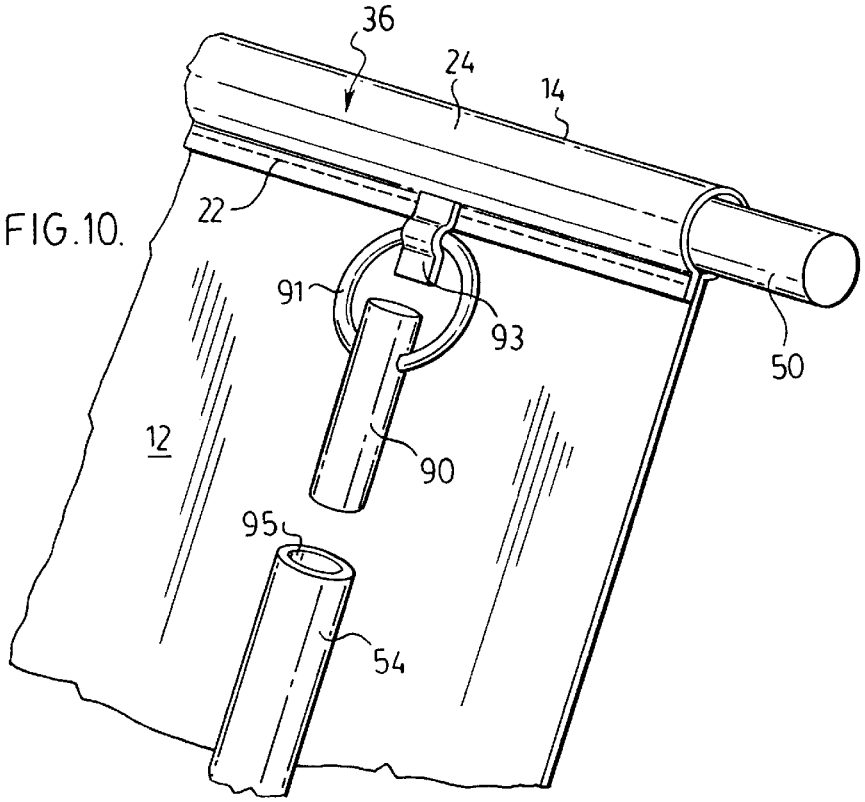
FIG. 10 is an exploded schematic pictorial view showing coupling of the transverse support rod member with a pin member.

Alternatively, FIG. 10 shows a rigid pin-like member 90 having one end pivotally carried on a rigid ring 91 secured to the sheet as by a small strap 93 and the other end of the pin-like member 90 being sized to extend longitudinally into a hollow bore 95 in the end of the transverse rod member 54.

Whether pockets or other sockets or grommets or pin-like members are used for coupling the transverse rod member 54 to the sheet, in all cases in accordance with the present invention, the sheet with its transverse rod member 54 coupled thereto is to be permitted to slide longitudinally on the longitudinal rod members.

The preferred embodiment of the shelter is particularly adapted for use on the ground. Where the ground has a configuration such as loose sand on a beach or a soil grassy surface or loose gravel, the ends 74 and 76 of the longitudinal rod members may be inserted into the ground and impaled therein to secure the shelter to the ground. Where this is not possible, the ends 74 and 76 could be secured in a relative location as by abutment against anchor member such as logs, rocks, steps and the like which would restrain ends 76 from moving in a direction away from the other ends 74.

FIG. 7 shows as a dotted line, a rope-like tether or tensioning member indicated as 92 which is adapted to have one end secured to a first end 74 of one longitudinal rod member and second end adapted to be secured to the second end 76 to the longitudinal rod member. This tensioning member may preferably comprise a length of string or cord and may be provided with a length adjustment mechanism. By having two such cords 92, one coupled between the ends of each of the two longitudinal rod members, the portable shelter is free standing and can be placed on any surface or moved about maintaining its arched configuration when the longitudinal rod members comprise flexible members.

A preferred embodiment of the invention shown in FIG. 1 has merely two longitudinal rod members, one at each side of the rectangular sheet 12. Additional longitudinal rod members may be provided coupled to the sheet in comparable sleeves such that the additional longitudinal rod members extend parallel to the first and second longitudinal rod members. For example, as shown in dotted lines in FIG. 8, a sleeve 96 could be sewn into the sheet 12 intermediate the sleeves 24 and 26 to carry a third longitudinal rod member 97 without impairing from the ability of the sheet 12 with its transverse rod members 54 being able to slide longitudinally. In a shelter having, for example, three equally transversely spaced longitudinal rod members, the transverse rod members could either extend across the entire width of the sheet 12 or, alternatively, separate pairs of pockets and transverse rod members could be provided to span transversely merely between each adjacent pair of longitudinal rod members.

Figure 11:
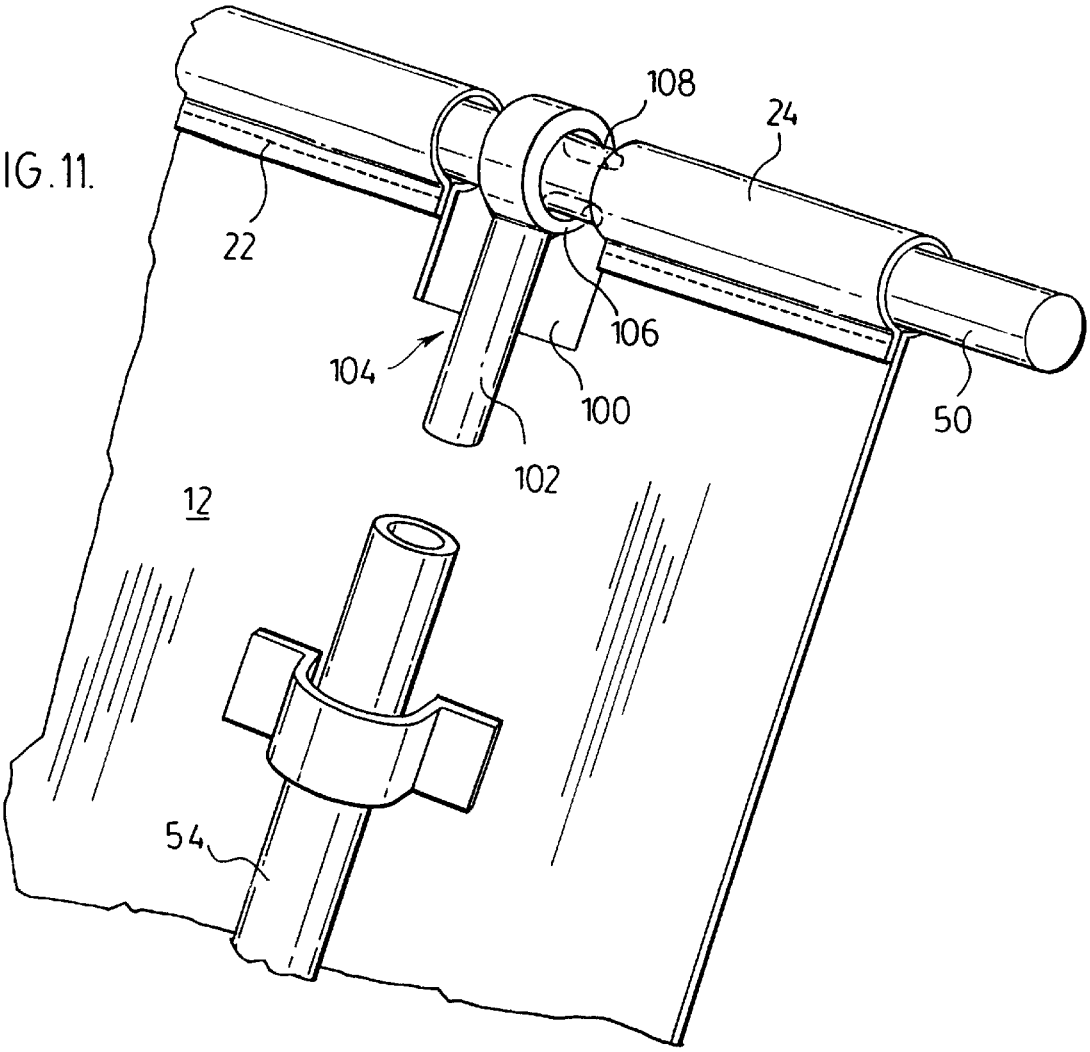
FIG. 11 is an exploded schematic pictorial view similar to FIG. 10 but of an alternate system for coupling the transverse rod member to the longitudinal rod member.
Figure 12:
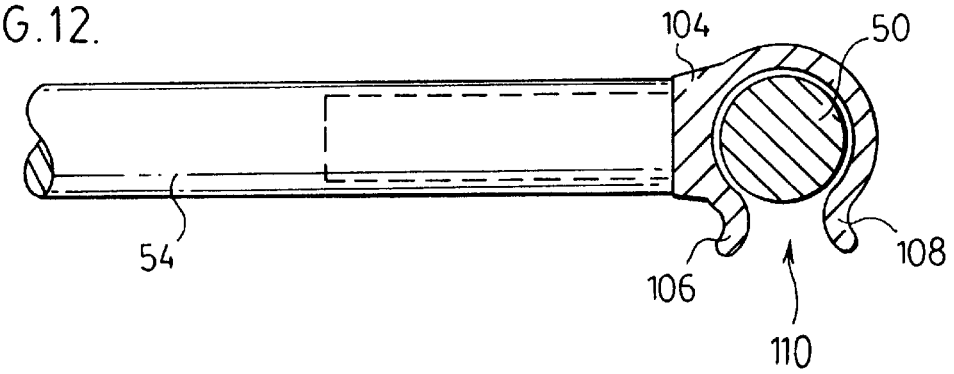
FIG. 12 is a side view showing coupling of the transverse rod member to the longitudinal rod member in FIG. 11.

Reference is made to FIGS. 11 and 12 which show an alternate configuration for coupling of the transverse rod member 54 to the longitudinal rod member 50. As seen in FIG. 11, the sheet 12 has a sleeve 24 along its side. A slot 100 is cut out of the sheet 12 to inside of the sleeve 24 such that the longitudinal rod member 50 is exposed in the slot 100. The transverse rod member 54 comprises a hollow tube with a C-shaped hook member 104 secured thereto by a cylindrical portion 102 of the hook member received inside the tube. The hook member 104 has two arms 106 and 108 adapted to engage about longitudinal rod member 50 to slidably receive the longitudinal rod member 50 therein. An opening 110 between arms 106 and 108 opens normal to the axis of the transverse rod member 54 such that forces acting axially on transverse rod member do not uncouple the hook member from rod member 50. The hook member 104 is preferably resilient such that arms 106 and 108 need to be deflected under manual pressure to couple or uncouple the hook member 104 on rod member 50. Preferably, the width of sheet 24 and the length of the transverse rod member 54 is selected such that the sheet 24 with its transverse rod member 54 will as a unit slide longitudinally on longitudinal rod members 50 and 52.

Figure 13:
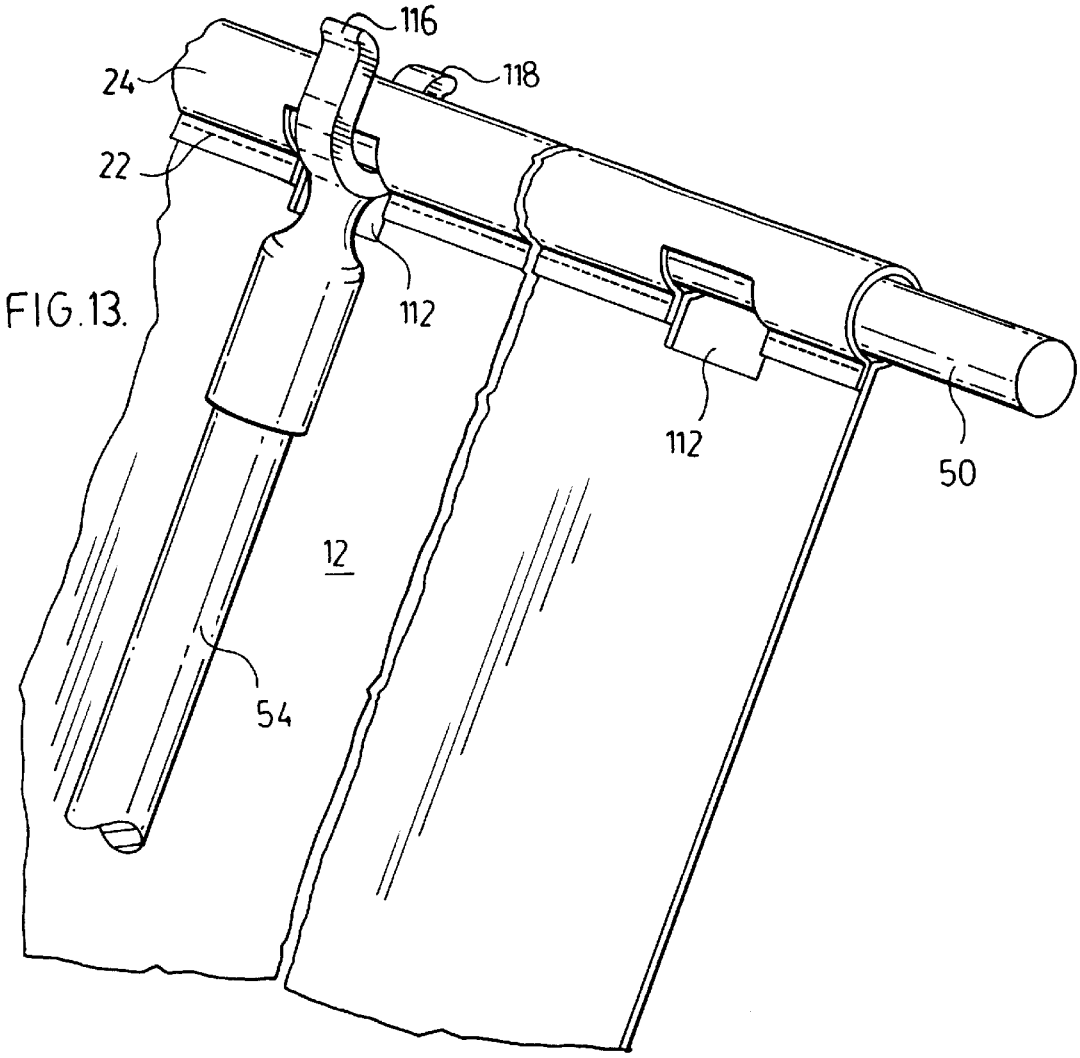
FIG. 13 is an exploded schematic pictorial view similar to FIG. 10 but of a further alternate system for coupling the transverse rod member to the longitudinal rod member.
Figure 14:
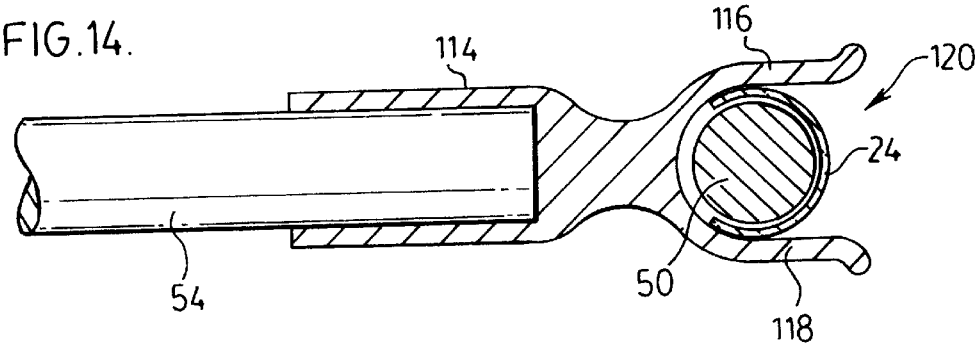
FIG. 14 is a side view showing coupling of the transverse rod member to the longitudinal rod member in FIG. 13.

Reference is made to FIGS. 13 and 14 which show another alternate configuration for coupling of the transverse rod member 54 to the longitudinal rod member 50. As seen in FIG. 13, a slot 112 is cut out from the sheet 24 on an inboard side of sleeve 24. The transverse rod member 54 carries a Y-shaped hook member 114 at its end. The hook member 114 has two arms 116 and 118 with an opening therebetween opening in the axial direction of transverse rod member 54 outwardly. With one arm 118 extending through slot 112, the rod member 50 is received in the bight of the hook member 114. The sheet 12 is preferably of a width having regard to the length of the transverse rod members 54 that the longitudinal rod members 50 and 52 remain within the bights of the hook members 114 unless manual forces are applied to stretch the sheet 12. Preferably, the sheet 12 together with its transverse rod members are as a unit longitudinally slidable on longitudinal rod members 50 and 52.

While the shelters are particularly adapted to be self supporting as, for example, on the ground, the shelter could also be useful to provide cover and/or shade in specific situation as, for example, to span a boat, for example, an open aluminum boat by having each of the ends 76 and 74 of the shelter received in vertically extending opening in the opposite sides thereof or otherwise.

Many variations and modifications of the invention will now occur to a person skilled in the art. For a definition of the invention, reference is made to the appended claims.

What I claim is:

1. A portable shelter comprising:

a trapezoidal sheet of fabric with parallel first and second sides and with first and second ends;

a first elongate longitudinal support rod member having a first end and a second end;

a second elongate longitudinal support rod member having a first end and a second end;

at least one elongate transverse support rod member having a first end and a second end;

first sleeve means disposed along the first side of the sheet;

second sleeve means disposed along the second side of the sheet;

the first longitudinal support rod member coupled to the sheet received in the first sleeve means for sliding therein parallel the first side;

the second longitudinal support rod member coupled to the sheet received in the second sleeve means for sliding therein parallel the second side;

each of the first and second longitudinal support rod members having their first and second ends extending beyond the first and second ends respectively of the sheet to support the shelter;

each transverse support rod member having its first end coupled to the sheet adjacent the first side and its second end coupled to the sheet adjacent the second side and extending therebetween transversely relative the first and second longitudinal support rod members to maintain the first and second longitudinal support rod members in spaced relation;

the first and second ends of each transverse support rod member coupled to the sheet independently of the first and second longitudinal support rod members such that the sheet with each transverse support rod member coupled thereto may slide longitudinally relative to the first and second longitudinal support rod members.

2. A shelter as claimed in claim 1 wherein the sleeve means comprises a first sleeve extending along the first side of the sheet and a second sleeve extending along the second side of the sheet.

3. A shelter as claimed in claim 2 wherein each of first and second sleeves comprise a portion of the fabric folded back upon itself and secured to itself.

4. A shelter as claimed in claim 1 wherein the longitudinal support rod members comprise flexible resilient rods biased to assume a straight configuration and adapted to be bent to assume various arched shapes.

5. A shelter as claimed in claim 4 wherein the resilient rods comprise flexible fibreglass rods.

6. A shelter as claimed in claim 5 wherein each transverse support rod member comprises a plurality of separate similar segments removably connectible by a short portion of each segment at one end being telescopically received within a short socket at a second end of an adjacent segment.

7. A portable shelter as claimed in claim 4 including:

a first tensioning member having a first end for securing to the first end of the first longitudinal support rod member and a second end for securing to the second end of the first longitudinal support rod member to maintain the first and second ends of the first longitudinal support rod member a fixed distance apart with the first longitudinal support rod member bent in an arched shape; and a second tensioning member having a first end for securing to the first end of the second longitudinal support rod member and a second end for securing to the second end of the second longitudinal support rod member to maintain the first and second ends of the second longitudinal support rod member a fixed distance apart with the second longitudinal support rod member bent in an arched shape.

8. A portable shelter as claimed in claim 4 wherein the ends of the first and second longitudinal support rod members are engaged in the ground with the first and second longitudinal support rod members bent in similar arched shapes.

9. A shelter as claimed in claim 1 wherein the longitudinal rods comprise a plurality of separate similar segments removably connectable by a short portion of each segment at one end being telescopically received within a short socket at a second end of an adjacent segment.

10. A shelter as claimed in claim 9 wherein each segment is a hollow tube and is connected to its adjacent segment by a length of elastic cord extending through the hollow tubes.

11. A shelter as claimed in claim 1 wherein the longitudinal support rod members comprise rigid rods having identical generally arched configurations.

12. A shelter as claimed in claim 1 including a pair of pocket members on the sheet for each transverse support rod member;

a first pocket member of each pair secured to the sheet adjacent the first side of the sheet and having an opening directed towards the second side of the sheet adapted for receiving a first end of the transverse support rod member;

a second pocket member of each pair secured to the sheet adjacent the second side of the sheet and having an opening directed towards the first side adapted to receive the second end of the transverse support rod member;

wherein with the transverse support rod member having its first and second ends received in the first and second pocket members of each pair, the transverse rod member tensions the sheet member transversely between the first and second longitudinal support rod members.

13. A shelter as claimed in claim 1 wherein a pair of attachment members is provided on the sheet for each transverse support rod members;

a first attachment member of each pair secured on the sheet adjacent a first side of the sheet and adapted for receiving a first end of the transverse support rod member;

a second attachment member of each pair secured on the sheet adjacent a second side of the sheet and adapted to receive a second end of the transverse support rod member;

wherein with the first and second ends of the transverse support rod member engaged with the first and second attachment members respectively, the transverse support rod member tensions the sheet member transversely between the first and second attachment members.

14. A shelter as claimed in claim 13 wherein the attachment members comprise a pair of socket members with a first socket member having an opening directed towards the second end adapted to receive the first end, of the transverse support rod member and a second attachment member comprising a second socket member directed towards the first side and adapted to receive the second end of the transverse support rod member.

15. A shelter as claimed in claim 14 wherein said first and second socket members comprise first and second grommets each having an opening therethrough;

each transverse support rod member having at each of its ends, a reduced diameter pin portion extending axially from an enlarged shoulder;

each pin portion sized to pass through the opening in the grommets and each shoulder sized be larger than the opening in the grommets.

16. A shelter as claimed in claim 14 wherein each of the first and second ends of the transverse support rod member comprising a hollow tube with an end opening and the first and second attachment means comprising an elongate pin coupled at one end to the sheet and having a second end to be received within the tube in each end of the transverse support rod member.

17. A shelter as claimed in claim 1 including a third elongate longitudinal support rod member secured to the sheet between the first and second longitudinal support rod members parallel thereto received in a third sleeve means coupled to the sheet.

18. A shelter as claimed in claim 1 including a plurality of said elongate transverse support rod members of the same length.

19. A portable shelter as claimed in claim 18 wherein the sheet is rectangular, the support rod members are of the same length and the sheet is of a length substantially less than the length of the longitudinal support rods wherein the sheet may slide between a first position with the first end of the sheet proximate the first end of the longitudinal support rod member and a second position with the second end of the sheet proximate the second end of the longitudinal support rod member.

20. A portable shelter as claimed in claim 1 wherein said fabric comprises a light weight fabric of nylon and each of said longitudinal support rod member and transverse support rod members comprising flexible fibreglass rods.

* * * * *